US011430320B2

(12) United States Patent
Peterson et al.

(10) Patent No.: US 11,430,320 B2
(45) Date of Patent: Aug. 30, 2022

(54) METHOD AND DEVICE TO NOTIFY AN INDIVIDUAL

(71) Applicant: Lenovo (Singapore) Pte. Ltd., New Tech Park (SG)

(72) Inventors: Nathan J. Peterson, Oxford, NC (US); Russell Speight VanBlon, Raleigh, NC (US); John Carl Mese, Cary, NC (US); Mark Patrick Delaney, Raleigh, NC (US); Arnold S. Weksler, Raleigh, NC (US)

(73) Assignee: LENOVO (SINGAPORE) PTE. LTD., New Tech Park (SG)

( * ) Notice: Subject to any disclaimer, the term of this patent is extended or adjusted under 35 U.S.C. 154(b) by 121 days.

(21) Appl. No.: 16/404,006

(22) Filed: May 6, 2019

(65) Prior Publication Data

US 2020/0357263 A1 Nov. 12, 2020

(51) Int. Cl.
*G08B 21/22* (2006.01)
*G08B 3/10* (2006.01)

(52) U.S. Cl.
CPC ..... *G08B 21/22* (2013.01); *G08B 3/10* (2013.01)

(58) Field of Classification Search
CPC ..... G08B 21/22; G08B 3/10
See application file for complete search history.

(56) References Cited

U.S. PATENT DOCUMENTS

2019/0254570 A1* 8/2019 Shinar ..... A61B 5/002
2020/0090486 A1* 3/2020 Laakkonen ..... A61B 5/4809
2020/0178887 A1* 6/2020 Correa Ramirez .. A61B 5/4806

* cited by examiner

*Primary Examiner* — Curtis B Odom
(74) *Attorney, Agent, or Firm* — The Small Patent Law Group LLC; Dean D. Small

(57) ABSTRACT

A computer implemented method, device and product are provided. The method is under control of one or more processors with specific executable program instructions to obtain presence data indicative of one or more people in an environment and analyze the presence data to determine activity of the one or more people in the environment. The method determines a first notification preference and a second notification preference based on the activity of the one or more people in the environment and generates a command to apply the first notification preference or the second notification preference at a predetermined time.

19 Claims, 4 Drawing Sheets

METHOD AND DEVICE TO NOTIFY AN INDIVIDUAL

FIELD

The present disclosure relates generally to electronic devices for notifying an individual of a predetermined time.

BACKGROUND OF THE INVENTION

Electronic devices are utilized for numerous purposes, including to wake individuals from sleep. Alarm clocks, smart phones, smart watches, wearable devices that monitor activity of an individual, such as a fitness tracking device, and the like may all include alarm features for waking an individual. The individual with the electronic device programs a predetermined time, and at the predetermined time a notification such as a sound, including beeps, music, readings, or the like is used to awake the individual. The individual then must actuate the electronic device to either snooze for a predetermined period when the notification again is provided, or turn the alarm feature off.

However, often an individual using the electronic device as an alarm is not the only person in the environment. For instance, in bedrooms, dorm rooms, or the like, a spouse, roommate, or another is typically also within the environment. Similarly, when an individual is in a public place such as an airport, shopping center, or the like and desires to be awoken from a nap, often many individuals may be in the environmental setting. In each of these instances, the alarm of the electronic device can often be heard by the other individual, or individuals within the environment. In the case of a spouse or roommate, the alarm may cause the individual to awake, causing annoyance and frustrations. In the public setting, the alarm similarly may cause annoyance to others in the area, and embarrassment to the individual using the alarm.

A need remains for improved methods and devices that will notify an individual that is sleeping, or in a non-active state, that reduces the probability that another individual in the environment will unintentionally be notified as well.

SUMMARY

In accordance with embodiments here, a computer implemented method is provided. The method is under control of one or more processors with specific executable program instructions to obtain presence data indicative of one or more people in an environment and analyze the presence data to determine activity of the one or more people in the environment. The method determines a first notification preference and a second notification preference based on the activity of the one or more people in the environment and generates a command to apply the first notification preference or the second notification preference at a predetermined time.

Optionally, the method may determine that a first person and a second person are within the environment based on the presence data. The method may determine that the first person is in an inactive state based on the presence data and may determine that the second person is in an inactive state based on the presence data. The method may select the first notification preference based the inactive state of the first person and the inactive state of the second person. The determining the first notification preference and second notification preference may include accessing a list that may include a first notification level and a second notification level. The first notification level may include non-auditory notifications and the second notification level may include auditory notifications. The second notification level may include auditory notifications at a first volume. The list may also include a third notification level. The third notification level may include auditory notifications at a second volume that is greater than the first volume.

Optionally, the method may select the first notification preference from at least one of the first notification level, the second notification level, or third notification level based on the inactive state of the second person. The method may transmit the command from a base device to a secondary device. The presence data may include at least one of global positioning system data, sound data, physiological data, or motion data.

In accordance with embodiments herein, an electronic device is provided. The electronic device includes one or more processors. Responsive to execution of the program instructions, the one or more processors obtains presence data indicative of one or more people in an environment and analyzes the presence data to determine activity of the one or more people in the environment. The electronic device determines a first notification preference and a second notification preference based on the activity of the one or more people in the environment and generates a command to apply the first notification preference or the second notification preference at a predetermined time.

Optionally, the one or more processors may determine that a first person and a second person are within the environment based on the presence data and may determine that the first person is in an inactive state based on the presence data. The processors may determine that the second person is in an inactive state based on the presence data and may select the first notification preference based the inactive state of the first person and the inactive state of the second person. Determining the first notification preference and second notification preference may include accessing a list that may include a first notification level and a second notification level. The first notification level may include non-auditory notifications and the second notification level includes auditory notifications. The second notification level may include auditory notifications at a first volume. The list may also include a third notification level. The third notification level may include auditory notifications at a second volume that may be greater than the first volume.

Optionally, the one or more processors may select the first notification preference from one of the first notification level, the second notification level, or third notification level based on the inactive state of the second person. The device may comprise at least one of a sound sensor, camera, global positioning system, or physiological sensor coupled to the one or more processors to obtain presence data indicative of one or more people in the environment. The electronic device may be at least one of an alarm clock, a smart phone, a television, a home automation electronic hub, or a wearable device. The one or more processors may determine that one person may be within the environment based on the presence data and may select the first notification preference to apply based on the one person being determined within the environment.

In accordance with embodiments herein, a computer program product is provided. The computer program product includes a non-signal computer readable storage medium comprising computer executable code to obtain presence data indicative of one or more people in an environment, analyze the presence data to determine activity of the one or more people in the environment and determine a first notification preference and a second notification preference based on the activity of the one or more people in the environment. The computer program product generates a command to apply the first notification preference at a predetermined time for a predetermined interval and generates a command to apply the second notification preference in response to the predetermined interval expiring.

Optionally, the non-signal computer readable storage medium may comprise computer executable code to determine that a first person and a second person are within the environment based on the presence data. The medium may determine that the first person is in an inactive state based on the presence data, determine that the second person is in an inactive state based on the presence data and may select the first notification preference based the inactive state of the first person and the inactive state of the second person.

Optionally, the non-signal computer readable storage medium may comprise computer executable code to determine that a first person and a second person are within the environment based on the presence data, may determine that the first person is in an inactive state based on the presence data, may determine that the second person is in an active state based on the presence data and may select the first notification preference based the inactive state of the first person and the active state of the second person. Determining the first notification preference and second notification preference may include accessing a list that may include a first notification level and a second notification level. The first notification level may include non-auditory notifications and the second notification level may include auditory notifications. The second notification level may include auditory notifications at a first volume. The list may also include a third notification level. The third notification level may include auditory notifications at a second volume that is greater than the first volume.

DETAILED DESCRIPTION

Figure 1:
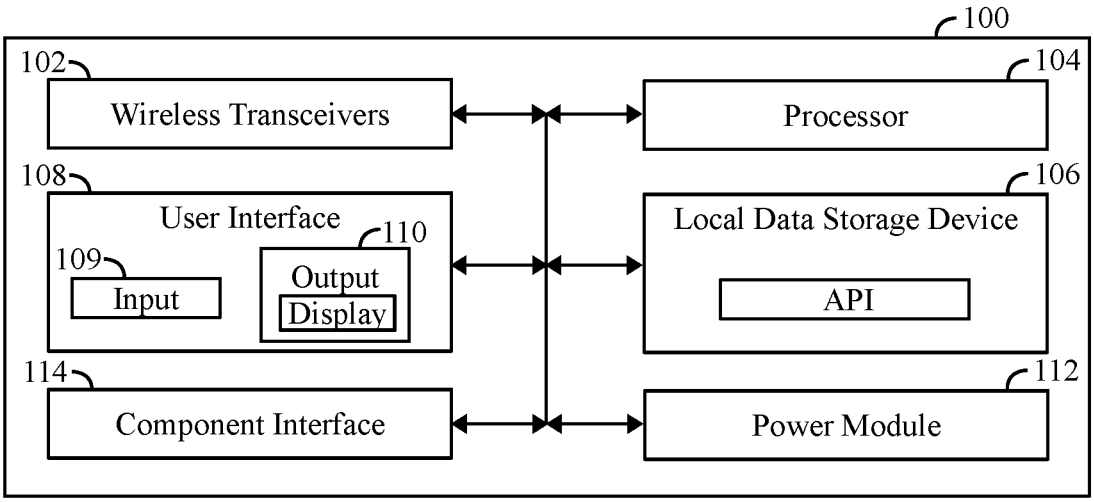
FIG. 1 illustrates a block diagram of an electronic device in accordance with an embodiment.

It will be readily understood that the components of the embodiments as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, appearances of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, etc. In other instances, well-known structures, materials, or operations are not shown or described in detail to avoid obfuscation. The following description is intended only by way of example, and simply illustrates certain example embodiments.

The term "notification preference" when used herein includes a preferred or desired manner in which an individual is notified or alerted based on the activity of one or more people in a given environment. The reason for the notification or alert may include to be woken from sleep, or to inform an individual of a predetermined time, including to go to sleep. The notifications include, but are not limited to tactile and haptic notifications, including device vibrations, auditory notifications, including beeps, music, prerecorded messages, volume changes, and light notifications, including actuating a light source, flashing a light source, and changing light output, or the like.

The term "presence data" when used herein includes any data, information, reading, input, or the like that may be obtained and/or utilized in relation to determining the existence of one or more people in an environment. Presence data may be obtained from any electronic device including a base device or a secondary device that communicates with a base device.

The term "activity" when used herein includes any and all actions that indicate an individual is awake or asleep. These actions include, but are not limited to breathing, heartbeats, heat signatures of an individual, sounds produced by an individual, motion of an individual, or the like. Activity includes an active state in which an individual is determined to be awake and an inactive state when the individual is determined to be asleep. While determined to be asleep or awake, the individual may not be asleep or awake, as determined.

The term "obtains" and "obtaining", as used in connection with data, signals, information and the like, include at least one of i) accessing memory of an external device or remote server where the data, signals, information, etc. are stored, ii) receiving the data, signals, information, etc. over a wireless communications link between the base device and a secondary device, and/or iii) receiving the data, signals, information, etc. at a remote server over a network connection. The obtaining operation, when from the perspective of a base device, may include sensing new signals in real time, and/or accessing memory to read stored data, signals, information, etc. from memory within the base device. The obtaining operation, when from the perspective of a secondary device, includes receiving the data, signals, information, etc. at a transceiver of the secondary device where the data, signals, information, etc. are transmitted from a base device and/or a remote server. The obtaining operation may be from the perspective of a remote server, such as when receiving the data, signals, information, etc. at a network interface from a local external device and/or directly from a base device. The remote server may also obtain the data, signals, information, etc. from local memory and/or from other memory, such as within a cloud storage environment and/or from the memory of a personal computer.

The term "command" when used herein includes instruction provided by a user, or one or more processors, to an input device, output device, other electronic devices, including base devices and secondary devices, or the like to provide a predetermined function, operation, action, or the like.

The term "environment" when used herein includes any area in which presence data may be collected or obtained by an electronic device, including a base device or secondary device. Environments include rooms, dwellings, airports, shopping centers, public parks, or the like.

FIG. 1 illustrates a simplified block diagram of internal components of an electronic device 100 in accordance with embodiments herein. The electronic device 100 may be an alarm clock, smart phone, home automation electronic hubs (e.g. the Amazon Echo device), wearable electronic device such as a device that monitors activity of an individual, including steps taken, heartrate, or the like, smart devices such as a tablet or iPad, smart watch, or the like. The device 100 includes components such as one or more wireless transceivers 102, one or more processors 104 (e.g., a microprocessor, microcomputer, application-specific integrated circuit, etc.), one or more local storage medium (also referred to as a memory) 106, a user interface 108 which includes one or more input devices 109 and one or more output devices 110, a power module 112, and a component interface 114. All of these components can be operatively coupled to one another, and can be in communication with one another, by way of one or more internal communication links, such as an internal bus.

The memory 106 can encompass one or more memory devices of any of a variety of forms (e.g., read only memory, random access memory, static random access memory, dynamic random access memory, etc.) and can be used by the processor 104 to store and retrieve data. The data that is stored by the memory 106 can include, but need not be limited to, operating systems, applications, user collected content and informational data. Each operating system includes executable code that controls basic functions of the device, such as interaction among the various components, communication with external devices via the wireless transceivers 102 and/or the component interface 114, and storage and retrieval of applications and data to and from the memory 106. Each application includes executable code that utilizes an operating system to provide more specific functionality for the communication devices, such as file system service and handling of protected and unprotected data stored in the memory 106.

Applications may be stored in the memory 106, including various application program interfaces (APIs), some of which provide links to/from the cloud hosting service. In one example, an application is provided that includes instructions for alerting or waking an individual utilizing a notification preference that is determined by the electronic device 100. Based on the instructions, the one or more processors 104 command input devices 109 to obtain presence data indicative of one or more people in an environment. The input devices 109 may include a visual input device such as an optical sensor or camera, infrared camera, an audio input device such as a microphone, a global positioning system, a motion sensor, proximity sensor, physiological sensors such as pulse rate monitors, and a mechanical input device such as a keyboard, keypad, selection hard and/or soft buttons, switch, touchpad, touch screen, icons on a touch screen, a touch sensitive areas on a touch sensitive screen and/or any combination thereof.

Based on the presence data obtained from the input devices 109, the one or more processors 104 analyze the presence data to determine activity of one or more people within the environment. In one example, the presence data is obtained by a motion sensor that provides that no objects are moving in the environment and obtained by a global positioning system within a remote device that transmits a signal to the one or more processors that the remote device is in the environment. In an example, when the remote device is a wearable device, the presence of the wearable device in the room indicates that a person is in the room, and the motion detector indicates that the individual is determined to be in an inactive state.

In another example, the input device 109 is a microphone that detects sounds being made by individuals in an environment. The microphone is able to detect both sound sources, and audible levels and compare them with previously determined audible levels to determine heavy breathing consistent with sleep, or snoozing. In this manner, if these sleeping based noises are detected, the one or more processors may determine two people are in a room and both are in an inactive state as a result of the sleeping noises.

In yet another example, the input device 109 receives transmissions from two separate physiological sensors. In particular, each physiological sensor is within a wearable device that monitors the heartrate of an individual. The one or more processors not only detect the presence of two heart beats, in addition, changes in heart beats are monitored to determine when the people in the environment are awake or asleep.

In each instance, one or more input devices 109 transmit presence data to the one or more processors, and based on this obtained presence data, an analysis of the presence data is undertaken to determine the number of individuals that are in an environment and determine the activity of each individual. Based on these determinations the one or more processors 104 select notification preferences to utilize in alerting or waking one of the individuals.

Selecting the notification preferences in one example includes accessing a list that includes a first notification level, a second notification level, and a third notification level. While three levels are described, in example embodiments only two levels are provided on the list, while in other example embodiments more than three levels are utilized.

In an example, each level represents a different methodology for alerting or waking an individual, with each methodology determined based on the probability or likelihood that another individual or individuals in an inactive state in the environment will be woken, or brought to an active state as a result of the use of the methodology. These are examples of individuals attempting to sleep with another individual in an environment, including roommates in dorm rooms, spouses in a bedroom, or the like. Alternatively, each level represents a different methodology for alerting or waking an individual, with each methodology determined based on the probability or likelihood that another individual or individuals in an active state in the environment may become annoyed or bothered as a result of the use of the methodology. These may be individuals attempting to nap or sleep in a public area such as an airport or shopping center without disturbing other individuals in the environment with the sound of an alarm.

In one example, the first notification level represents non-auditory notification preferences. These include tactile, or haptic inputs, such as vibrating of the device, vibrating a remote device, including a bed, zone or portion of a bed, smart phone, wearable device, or the like, turning on a light source that shines directly on the waking person, flashing a light source, or the like. Therefore, the one or more processors determine, based on the analysis of the presence data, that for a first notification preference, the notification preference should be selected form the first level, and an individual may set which notification preference in that level is preferred. If the individual desires their device to vibrate, and the first level is selected, a command to vibrate the device may be selected as the first notification level.

Similarly, in the example, the second notification level represents low volume audible sounds. These low volume audible sounds are below a threshold decibel level and may include beeping, music, talking, or the like. In one example, the threshold decibel level is 30 decibels (30 DB) with sounds less than 30 DB considered low level audible sounds. Again, an individual may select which low volume sound is most desired. Then, based on the analysis of the presence data, the one or more processors may select the notification preference chosen by the individual within the second notification level to be a second notification level. Thus, in one example, if the one or more processors 104 transmit a command to apply the first notification preference of vibrating the device 100, and the individual does not respond, after a predetermined interval the one or more processors transmit a command to apply the second notification preference of a low volume level beep or tone.

In the example, a third notification level represents high volume audible sounds. These high audible sounds are above a threshold decibel level and may include beeping, music, talking, or the like. In one example, the threshold decibel level is 30 DB with sounds greater than 30 DB being considered high volume sounds. In an example, if, after the command to apply the second notification level the individual does not respond, remaining in an inactive state, after another predetermined interval, the one or more processors transmit a command to apply the third notification. In one example, when the individual does not choose a preferred notification preference at the third level, the one or more processors select the same audible sound as the second notification preference. By utilizing a tiered notification methodology to alert or awake an individual, the electronic device 100 reduces the likelihood that another individual will transition from an inactive state to an active state, or an individual will become annoyed in a public location.

While in this example the first, second, and third levels are determined based on sound characteristics, in other examples the first, second, and third levels are determined based on determinations related to other factors. For example, transmitting a command to apply a notification preference of turning on a light, while non-auditory, may be in the third level, while in an example when the device is a smart headphone, a low auditory sound may be presented in a first level of notification preferences. Additionally, while the one or more processors may determine each notification preference, and when to utilize each preference, an individual may provide manual input related to each level, or when to utilize notification preferences. For example, when a roommate or spouse leaves for a weekend resulting in only one individual sleeping in a room, the user may input the third level notification preference is to be utilized during the weekend, without the one or more processors making additional determinations.

With reference again to FIG. 1, the transceiver 102 can utilize a known wireless technology for communication. Exemplary operation of the wireless transceivers 102 in conjunction with other components of the device 100 may take a variety of forms and may include, for example, operation in which, upon reception of wireless signals, the components of device 100 detect communication signals from secondary devices and the transceiver 102 demodulates the communication signals to recover incoming information, such as responses to inquiry requests, voice and/or data, transmitted by the wireless signals. The processor 104 formats outgoing information and conveys the outgoing information to one or more of the wireless transceivers 102 for modulation to communication signals. The wireless transceiver(s) 102 convey the modulated signals to a remote device, such as a cell tower or a remote server (not shown). The transceiver receives communication from input devices 109 and transmits commands to output devices 110. In each instance, the input device 109 and/or output device 110 may be assembled with, coupled to, or part of the device 100, or alternatively, may be remote of the device 100. Output devices 110 can include a visual output device such as a light, an audio output device such as a speaker, alarm and/or buzzer, a mechanical output device such as a vibrating mechanism, or the like.

The power module 112 preferably includes a power supply, such as a battery, for providing power to the other components while enabling the device 100 to be portable, as well as circuitry providing for the battery to be recharged. The component interface 114 provides a direct connection to other devices, auxiliary components, or accessories for additional or enhanced functionality, and in particular, can include a USB port for linking to a user device with a USB cable.

Figure 2:
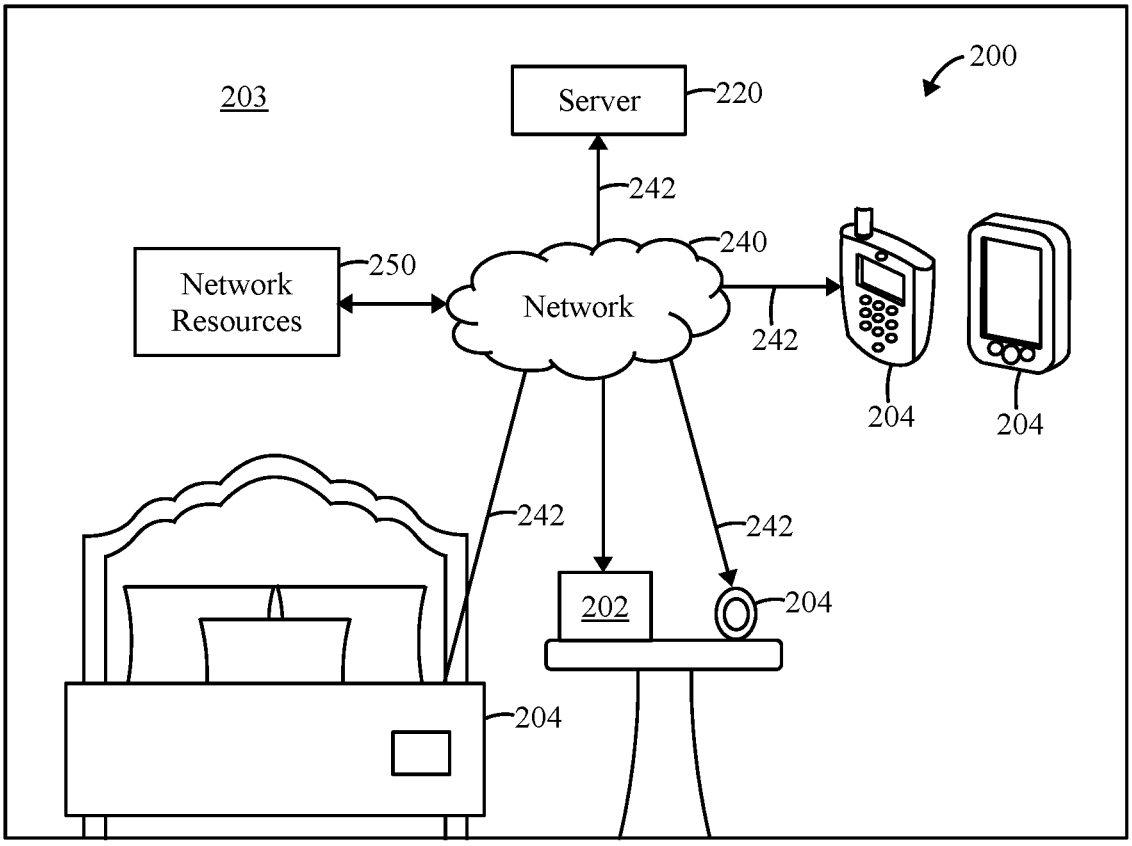
FIG. 2 illustrates a block diagram of a base device and secondary devices in accordance with an embodiment.

FIG. 2 is a block diagram of a system 200 for supporting management of secondary devices by one or more base devices in an environment 203 in accordance with embodiments herein. In this example, the environment 203 is illustrated as a bedroom, though in other embodiments the environment may be a dorm room, living room, apartment, airport, park, shopping center, or the like. The system 200 includes a base device 202, one or more secondary devices 204, and one or more device management servers 220. In one example, the base device 202 is the electronic device 100 of FIG. 1. Alternatively, one of the secondary devices 204 is the electronic device 100 of FIG. 1. By way of example, the base device 202 may be an alarm clock, mobile device, such as a cellular telephone, smartphone, tablet computer, personal digital assistant, laptop/desktop computer, gaming system, a media streaming hub device, wearable device, or other electronic terminal that includes a user interface and may access a network 240 over a wired or wireless connection. As non-limiting examples, the base device 202 may access the network 240 through a wireless communications channel and/or through a network connection (e.g. the Internet). Optionally, the base device 202 may be responsive to voice commands. Additionally or alternatively, the base device 202 may be a wired or wireless communication terminal, such as a desktop computer, laptop computer, network-ready television, set-top box, and the like. The base device 202 may access the network using a web browser or a native application executing thereon. In some embodiments, the base device 202 may have a physical size or form factor that enables it to be easily carried or transported by a user, or the base device 202 may have a larger physical size or form factor than a mobile device.

The secondary device 204 may represent the same or different type of device as the base device 202, such as a tablet computer, mobile phone, personal digital assistant, laptop/desktop computer and the like. In addition, other non-limiting examples of secondary devices 204 include alarm clocks, beds, televisions, stereos, home appliances, network devices (e.g. routers, hubs, etc.), remote-controlled electronic devices, a wearable device such as a smart watch, smart glasses, smart headphones, or the like, home automation electronic hubs (e.g. the Amazon Echo device), content management and streaming devices (e.g. the Chrome Cast device, Roku device, Kire TV stick device, Sonos devices), video games, cameras, camcorders, bed, drones, toys, home theater systems, automobiles, GPS systems, audio content players and the like.

In one example, the base device 202 may represent an alarm clock that communicates with a cellular network over one or more communications channels 242. The communication between the base device 202 and the cellular network may be unidirectional or bidirectional. A communications channel 242 may be provided by any communications provider, such as any source that disseminates information. The network 240 and communications channel 242 may be physically/logically separate channels. Optionally, the network 240 and communications channel 242 may be separate channels over the same underlying network. The base device 202 may access network resources 250, including web-based or network-based data, applications, and services, via the network 240. The network 240 may represent one or more of a local area network (LAN), a wide area network (WAN), an Intranet or other private network that may not be accessible by the general public, or a global network, such as the Internet or other publicly accessible network. The network 240 provides communication between the base device 202 and one or more network resources 250. The online resources 250 (including the data management server 220) include one or more network transceiver, processor, memory, and/or other circuitry that may coordinate and manage operations as described herein.

In an example, when the base device 202 is an alarm clock, the base device may include plural input devices (e.g. input devices 109) that obtain presence data indicative of one or more people in an environment. As described above, the input devices may include a visual input device such as an optical sensor or camera, infrared camera, an audio input device such as a microphone, a global positioning system, a motion sensor, proximity sensor, physiological sensors such as pulse rate monitors, and a mechanical input device such as a keyboard, keypad, selection hard and/or soft buttons, switch, touchpad, touch screen, icons on a touch screen, touch sensitive areas on a touch sensitive screen and/or any combination thereof. In addition to the input devices of the base device 202, the base device also communicates with the secondary devices 204 over the network 240 and/or communication channels 242 to receive presence data from secondary devices 204. The presence data may be within a memory of the secondary device, or transmitted from input devices of the secondary device to the base device. In one example, the base device is an alarm clock and the secondary device is a smart watch that includes a heartrate monitor. The heartrate monitor transmits heartrate data to the alarm clock, where one or more processors of the alarm clock may analyze the heartrate data to determine a notification preference based on the activity of the wearer.

Similarly, each secondary device 204 may also include one or more processors and communicate with the base device 202 to apply notification preferences to an individual. In one example, the base device 202 is an alarm clock and the secondary device 204 is a bed that includes separate zones for individuals that may vibrate or move. At a predetermined time for an individual to wake, the base device 202, based on presence data obtained, transmits a command to apply a selected notification preference to the bed. In this example, the notification provided is vibration of the side of the bed closest to the alarm clock. In another example, when the base device 202 is an alarm clock and the secondary device is smart watch, the notification provided is a vibration of the smart watch.

In yet another example, the base device 202 is a smart watch and the secondary device 204 is a smart light. In this example, the base device transmits a command to apply a first notification selected, to turn on the smart light at a first, low, dimmer setting. If an individual remains inactive after this first notification, a command to apply a selected second notification preference that is transmitted after a predetermined interval where the second notification is increasing the dimmer setting to a maximum light output setting. If after another predetermined interval, the individual remains inactive, a command to apply a selected third notification preference is generated, and the smart watch provides an auditory alarm. Therefore, the base device 202 may apply the notification preference selected, or may transmit the command to have a secondary device 204 apply the preference selected. In this manner, additional notification preferences may be provided that can be utilized to reduce the amount of times another individual is notified by the notification.

Figure 3:
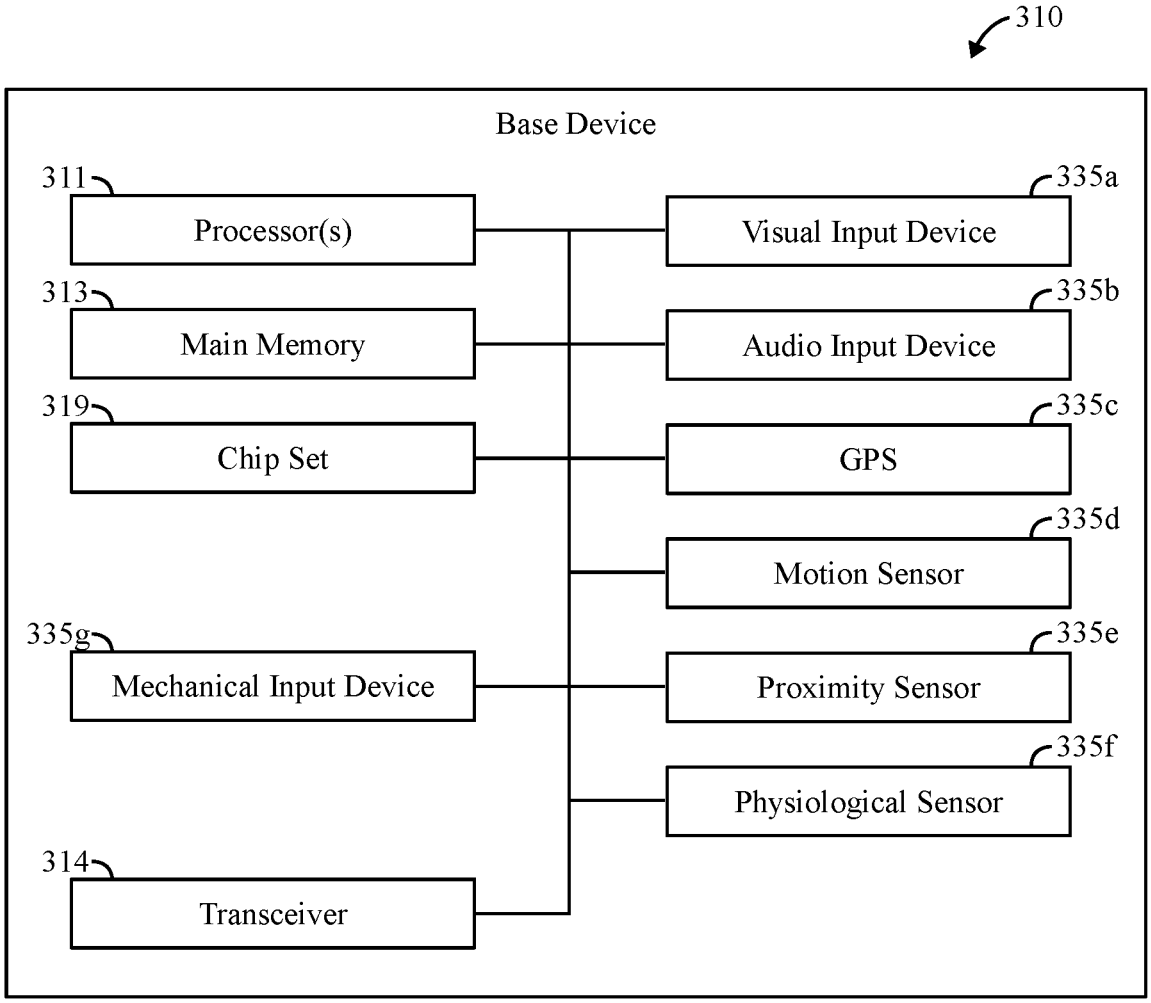
FIG. 3 is a functional block diagram illustrating the hardware configuration of a base device implemented in accordance with an alternative embodiment.

FIG. 3 is a functional block diagram illustrating the hardware configuration of another example base device 310 implemented in accordance with an alternative embodiment. The base device 310 includes one or more processors 311, coupled to a main memory 313, transceiver 314, and a chip set 319. The chip set 319 includes a real time clock (RTC) controller.

Plural input devices 335*a-g* are provided that are coupled to the one or more processors 311. Included is a visual input device 335*a* that in one example is an optical sensor. Alternatively and additionally, the visual input device 335*a* may be a camera, infrared camera, or the like. An audio input device 335*b* is also provided. In one example, the audio input 335*b* may be a microphone. Yet other input devices coupled to the one or more processors may include a global positioning system 335*c*, a motion sensor 335*d*, a proximity sensor 335*e*, physiological sensors 335*f* including pulse rate monitors, a mechanical input device 335*g* including a keyboard, keypad, selection hard and/or soft buttons, switch, touchpad, touch screen, icons on a touch screen, a touch sensitive areas on a touch sensitive screen and/or any combination thereof. Specifically, the base device 310 may include only one of these input devices 335*a-g*, two of the input devices 335*a-g*, or more. In an example, the base device 310 is an alarm clock and may have a visual input device 335*a*, audio input device 335*b*, motion sensor 335*d*, proximity sensor 335*e*, and a mechanical input device 335*g*, but not have a global positioning system 335*c*, or physiological sensors 335*f* Whereas when the base device 310 is a wearable device, the wearable device may include the visual input device 335*a*, audio input device 335*b*, global positioning system 335*c*, physiological sensors 335*f*, and a mechanical input device 335*g*, but not a motion sensor 335*d* or proximity sensor 335*e*. In each example, input devices 335*a-g* are selected based on the type of base device 310 that is provided in order to collect presence data indicative of one or more persons within an environment. This presence data is then analyzed to determine the notification preferences to provide to an individual that desires to wake from sleep as described herein.

Figure 4:
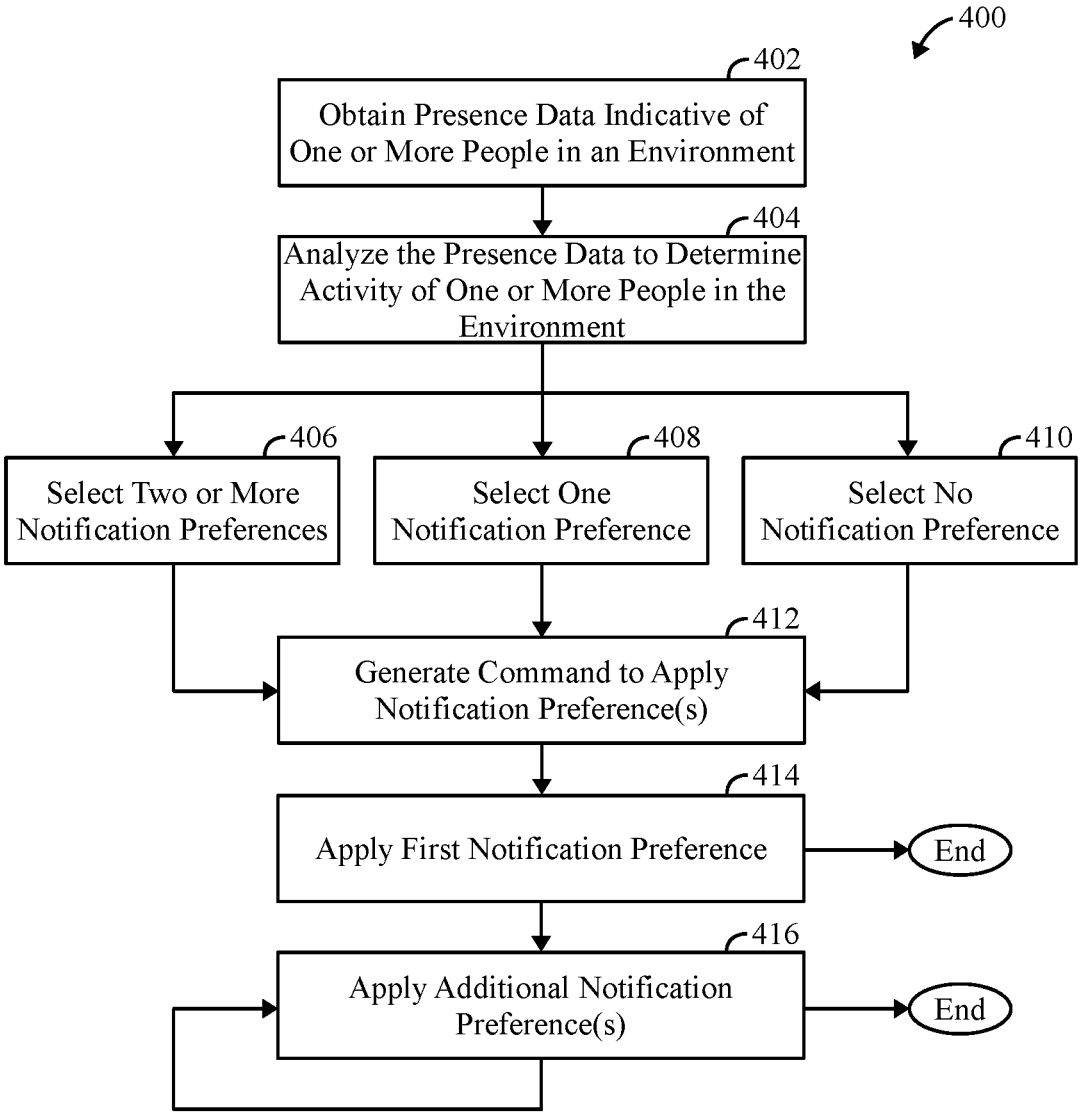
FIG. 4 illustrates a process for applying one or more notifications in accordance with embodiments herein.

FIG. 4 is a process 400 for applying one or more notifications to an individual utilizing the electronic device 100, including a base device 202, 310 or a secondary device 204. In one example the individual is in an inactive state, wherein in another example the individual is in an active state.

At 402, one or more processors 311 obtain presence data indicative of one or more people in an environment. In one example, the one or more processors 311 receive presence data from at least one input device 335*a-g* of the electronic device 100. In another example, the one or more processors receive presence data from at least one secondary device 204 that senses, detects, or receives presence data and transmits this presence data to the base device 202, 310 as described herein.

At 404, the one or more processors 311 analyze the presence data to determine activity of the one or more people in the environment. Initially, the one or more processors 311 determine the number of individuals that are in the environment. Then, the one or more processors determine whether each determined individual in an environment is in an active state or an inactive state. In one example, the one or more processors 311 determine a first person and a second person are within the environment. In other examples, only one person, or no people are determined to be within the environment. The environment may include a bedroom in a dwelling, a living room or other room in the dwelling, a dorm room, a hotel room, an airport, or other environment where more than one individual may exist, and an individual desires to rest or sleep and be awoken by a notification, such as an alarm.

In one example, the presence data is analyzed utilizing one or more mathematical processes including algorithms that calculate or determine the number of individuals within the environment and their activity based on the presence data. Alternatively and additionally, a look-up table is utilized where the presence data is compared to historical data to determine the activity of the individual. Historical data may include presence data related to an individual, averages of presence data of plural individuals, studies related to presence data, tables related to presence data, reference materials related to presence data, or the like. In one example, the heartrate of an individual is monitored over a predetermined interval to determine the individual's heartrate when in an inactive state as compared to when in an active state. Specifically, an individual's average heartrate from 2 AM to 4 AM is detected every night for a week to establish the inactive state presence data historical data. Similarly, the average heartrate of the same individual is detected from 2 PM to 4 PM for the same week, to provide active state historical data of presence data for the look-up table. The one or more processors 311 then monitor the heartrate of the individual and continuously compare the heartrate to the average heartrate in the look-up table from when the individual is active and inactive to determine the activity of that individual.

In yet another example, the one or more processors 311 based on historical data determines a threshold. In the example of heartrate, when an individual's inactive heartrate (2 AM-4 AM) is 60 beats per minute and their active heartrate is 75 beats per minute (2 PM-4 PM), the threshold heartrate is set at 65 beats per minute. When an individual's heartrate is detected as more than 65 beats per minute, the individual is determined to be in an active state, whereas if the individual's heartrate is determined to be 65 beats per minute or less, the individual is determined to be in an inactive state. While the example provides only heartrate as the presence data, in other examples, more than one characteristic of interest is utilized. As an example, decibel level and GPS location may to utilized. In yet another example, image data from a camera, decibel levels, GPS location, and heartrate are all utilized.

At 406, the one or more processors select two or more notification preferences when at 404, a determination is made that an individual in an inactive state is in the environment with the individual associated with the electronic device 100. For example, when a determination is made that two inactive individuals are within an environment, the one or more processors select a first notification preference to be a beep at a first volume level, and the second notification preference to be the beep at a second volume level where the first volume level is lower than the second volume level. This results in an attempt to wake the individual associated with the electronic device at a lower volume level before using a higher volume level, to reduce the likelihood the other inactive individual awakes.

Notification preferences may include, vibration of the electronic device, actuating a lighting device, increasing or decreasing light output of a lighting device, audible sounds, including increasing and decreasing audible sound levels, actuation of a remote device including a television, or the like. The audible sounds may include beeping, music, radio, tone, automated voice, or the like. Specifically, each audible sound may be grouped based on the volume level of the sound. Additionally, the individual may pre-select a desired notification. In an example, an individual may select to have an audible sound of a beep in order to wake them up.

In one example, notification preferences include accessing a list that includes a first notification level, a second notification level, and a third notification level. While three levels are described, in example embodiments, only two levels are provided on the list, while in other example embodiments more than three levels are utilized.

At 408, the one or more processors select one notification preference, when at 404, a determination is made that an individual in an active state is in the environment with the individual associated with the electronic device. In an example, when two individuals are determined to be in the environment with the person associated with the electronic device 100 determined to be in an inactive state and the detected individual not associated with the electronic device 100 determined to be in an active state, the one or more processors determine only one notification preference, a beep at a second, or high, volume level, is to be provided. Because the other individual in the environment is already determined to be in an active state, there is no need to have a notification as a lower volume, because the other individual is already awake.

At 410, the one or more processors select no notification as the notification preference, when at 404, a determination is made that no individuals are in an environment, or that the individual associated with the electronic device 100 is not in the environment. In an example, the request for a notification from an alarm clock is accidentally left on, even though no one is in a room. When the time for notification occurs, no notification is provided, preventing annoyance of a notification from individuals in other environments in the dwelling.

At 412, one or more processors generate command(s) to apply the notification preference(s) determined at predetermined time(s). In one example, the command is generated and sent to an output device 110 of the electronic device 100. In another example, the command is generated and transmitted to a secondary device 204. In yet another example, a first notification preference is provided to an output device 110 and a second notification preference is transmitted to a secondary device 204.

At 414, one or more processors apply an initial, or first notification. The first notification in one example, is the only notification provided. Alternatively, the first notification may be that no notification is provided. In response to the first notification, an individual may manually end the method by turning off the output device, hitting a snooze button, or the like.

At 416, if an individual does not manually end the method, one or more processors apply additional notifications. In one example a second notification is provided at a volume that is greater than a volume of the first notification. In another example a second notification is provided at a light output that is greater than the light output than the first notification. In yet another example, the first notification applied is a vibration, whereas the second notification is auditory. In another example, a third notification is applied after a predetermined interval. The final notification may be terminated manually by an individual, or after a predetermined amount of time.

Figure 5:
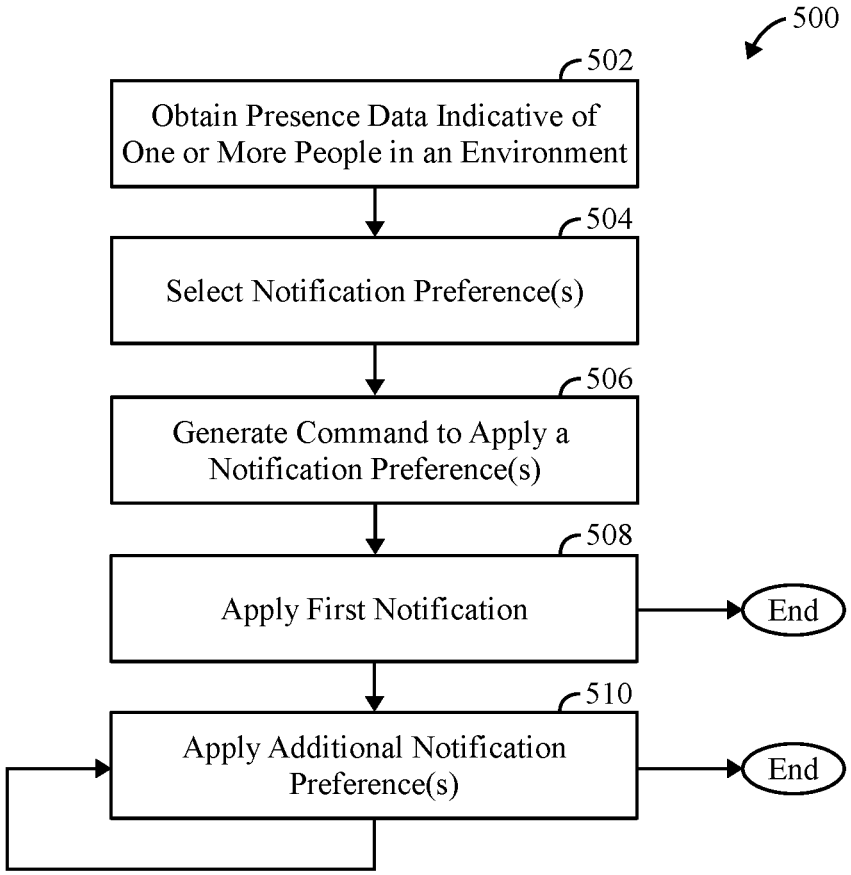
FIG. 5 illustrates a process for applying one or more notifications in accordance with embodiments herein.

FIG. 5 is a process 500 for applying one or more notifications to an individual utilizing the electronic device 100. In one example, the individual is in an inactive state, wherein in another example the individual is in an active state.

At 502, one or more processors 311 obtain presence data indicative of one or more people in an environment. In one example, the one or more processors 311 receive presence data from at least one input device 335*a-g* of the electronic device 100. In one such example, the electronic device 100 is a wearable device and the individual is in a public place such as an airport, thus, other devices, including secondary devices may not exist.

At 504, the one or more processors 311 determine notification preferences based on obtaining the presence data indicative of one or more people in the environment. In an example, when the electronic device is in a public location, including an airport, an individual may manually place the electronic device in a public place mode wherein preferences are determined based on any indication individuals are in the environment, whether in a non-active state or an active state. In this example, a first notification preference may be a vibration of the electronic device, and a second notification preference may be a low volume auditory alarm.

At 506, the one or more processors generate commands to apply the notification preference(s) determined at predetermined time(s). In one example, the command is generated and sent to an output device 110 of the electronic device 100. In another example, the command is generated and transmitted to a secondary device 204. In the example, the electronic device 100 is a base device that is a smart phone and the secondary device is a wearable device. In yet another example, a first notification preference is provided to an output device 110 and a second notification preference is transmitted to a secondary device 204.

At 508, the one or more processors apply an initial, or first notification. The first notification in one example, is the only notification provided. In response to the first notification, an individual may manually end the method by turning off the output device, hitting a snooze button, actuating a phone, or the like.

At 510, if an individual does not manually end the method, the one or more processors apply additional notifications. In yet one example, the first notification applied is a vibration, whereas the second notification is auditory. The final notification preference may be terminated manually by an individual, or after a predetermined amount of time.

Provided is an electronic device and method for notifying an individual of an event, such as a predetermined time, in a manner that reduces waking or annoying other individuals in a shared environment. By determining individuals are within an environment, along with their activity, tiered notification preferences are utilized to alert the individual in manners best suited for the environment.

CLOSING STATEMENTS

Before concluding, it is to be understood that although e.g. a software application for undertaking embodiments herein may be vended with a device such as the system, embodiments herein apply in instances where such an application is e.g. downloaded from a server to a device over a network such as the Internet. Furthermore, embodiments herein apply in instances where e.g. such an application is included on a computer readable storage medium that is being vended and/or provided, where the computer readable storage medium is not a carrier wave or a signal per se.

As will be appreciated by one skilled in the art, various aspects may be embodied as a system, method or computer (device) program product. Accordingly, aspects may take the form of an entirely hardware embodiment or an embodiment including hardware and software that may all generally be referred to herein as a "circuit," "module" or "system." Furthermore, aspects may take the form of a computer (device) program product embodied in one or more computer (device) readable storage medium(s) having computer (device) readable program code embodied thereon.

Any combination of one or more non-signal computer (device) readable medium(s) may be utilized. The non-signal medium may be a storage medium. A storage medium may be, for example, an electronic, magnetic, optical, electromagnetic, infrared, or semiconductor system, apparatus, or device, or any suitable combination of the foregoing. More specific examples of a storage medium would include the following: a portable computer diskette, a hard disk, a random access memory (RAM), a dynamic random access memory (DRAM), a read-only memory (ROM), an erasable programmable read-only memory (EPROM or Flash memory), a portable compact disc read-only memory (CD-ROM), an optical storage device, a magnetic storage device, or any suitable combination of the foregoing.

Program code for carrying out operations may be written in any combination of one or more programming languages. The program code may execute entirely on a single device, partly on a single device, as a stand-alone software package, partly on single device and partly on another device, or entirely on the other device. In some cases, the devices may be connected through any type of network, including a local area network (LAN) or a wide area network (WAN), or the connection may be made through other devices (for example, through the Internet using an Internet Service Provider) or through a hard wire connection, such as over a USB connection. For example, a server having a first processor, a network interface, and a storage device for storing code may store the program code for carrying out the operations and provide this code through its network interface via a network to a second device having a second processor for execution of the code on the second device.

The units/modules/applications herein may include any processor-based or microprocessor-based system including systems using microcontrollers, reduced instruction set computers (RISC), application specific integrated circuits (ASICs), field-programmable gate arrays (FPGAs), logic circuits, and any other circuit or processor capable of executing the functions described herein. Additionally or alternatively, the units/modules/controllers herein may represent circuit modules that may be implemented as hardware with associated instructions (for example, software stored on a tangible and non-transitory computer readable storage medium, such as a computer hard drive, ROM, RAM, or the like) that perform the operations described herein. The above examples are exemplary only, and are thus not intended to limit in any way the definition and/or meaning of the term "controller." The units/modules/applications herein may execute a set of instructions that are stored in one or more storage elements, in order to process data. The storage elements may also store data or other information as desired or needed. The storage element may be in the form of an information source or a physical memory element within the modules/controllers herein. The set of instructions may include various commands that instruct the units/modules/applications herein to perform specific operations such as the methods and processes of the various embodiments of the subject matter described herein. The set of instructions may be in the form of a software program. The software may be in various forms such as system software or application software. Further, the software may be in the form of a collection of separate programs or modules, a program module within a larger program or a portion of a program module. The software also may include modular programming in the form of object-oriented programming. The processing of input data by the processing machine may be in response to user commands, or in response to results of previous processing, or in response to a request made by another processing machine.

It is to be understood that the subject matter described herein is not limited in its application to the details of construction and the arrangement of components set forth in the description herein or illustrated in the drawings hereof. The subject matter described herein is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, in the following claims, the phrases "at least A or B", "A and/or B", and "one or more of A and B" (where "A" and "B" represent claim elements), are used to encompass i) A, ii) B and/or iii) both A and B. For the avoidance of doubt, if a claim limitation recited "utilizing one or more of the wireless activity and timestamp", such limitation means and shall encompass i) "utilizing the wireless activity", ii) "utilizing the timestamp" and/or iii) "utilizing both the wireless activity and the timestamp".

It is to be understood that the above description is intended to be illustrative, and not restrictive. For example, the above-described embodiments (and/or aspects thereof) may be used in combination with each other. In addition, many modifications may be made to adapt a particular situation or material to the teachings herein without departing from its scope. While the dimensions, types of materials and coatings described herein are intended to define various parameters, they are by no means limiting and are illustrative in nature. Many other embodiments will be apparent to those of skill in the art upon reviewing the above description. The scope of the embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects or order of execution on their acts.

What is claimed is:

1. A computer implemented method, comprising:

under control of one or more processors with specific executable program instructions to perform:

obtaining presence data indicative of one or more people in an environment;

analyzing the presence data to determine activity of the one or more people in the environment;

determining a first notification preference and a second notification preference based on the activity of the one or more people in the environment;

generating a command to apply the first notification preference at a predetermined time for a predetermined interval;

transmitting the command from a base device to a secondary device via a network over a communications channel that is physically separate from the network; and in response to the applying of the first notification preference for the predetermined interval, and based on the activity of the one or more people in the environment, applying the second notification preference applying the second notification with the secondary device.

2. The method of claim 1, further comprising:

determining that a first person and a second person are within the environment based on the presence data;

determining that the first person is in an inactive state based on the presence data;

determining that the second person is in an inactive state based on the presence data;

selecting the first notification preference based the inactive state of the first person and the inactive state of the second person.

3. The method of claim 2, wherein determining the first notification preference and second notification preference includes accessing a list that includes a first notification level and a second notification level; wherein the first notification level includes non-auditory notifications and the second notification level includes auditory notifications.

4. The method of claim 3, wherein the second notification level includes auditory notifications at a first volume; and wherein the list also includes a third notification level; wherein the third notification level includes auditory notifications at a second volume that is greater than the first volume; and wherein the second volume is selected in response to the expiration of the predetermined interval and the activity of the one or more people in the environment.

5. The method of claim 4, further comprising:

selecting the first notification preference from at least one of the first notification level, the second notification level, or third notification level based on the inactive state of the second person.

6. The method of claim 1, wherein the presence data includes at least one of global positioning system data, sound data, physiological data, or motion data.

7. An electronic device, comprising:

one or more processors;

wherein, responsive to execution of the program instructions, the one or more processors perform the following:

obtain presence data indicative of one or more people in an environment;

analyze the presence data to determine activity of the one or more people in the environment;

determine a first notification preference and a second notification preference based on the activity of the one or more people in the environment;

applying the first notification preference at a predetermined time for a predetermined interval; and command a secondary device via a network over a communications channel that is physically separate from the network to apply the second notification preference in response to the predetermined interval expiring and based on the activity of the one or more people in the environment.

8. The electronic device of claim 7, wherein the one or more processors further perform the following:

determine that a first person and a second person are within the environment based on the presence data;

determine that the first person is in an inactive state based on the presence data;

determine that the second person is in an inactive state based on the presence data;

select the first notification preference based the inactive state of the first person and the inactive state of the second person.

9. The electronic device of claim 8, wherein determining the first notification preference and second notification preference includes accessing a list that includes a first notification level and a second notification level; wherein the first notification level includes non-auditory notifications and the second notification level includes auditory notifications.

10. The electronic device of claim 9, wherein the second notification level includes auditory notifications at a first volume; and wherein the list also includes a third notification level; wherein the third notification level includes auditory notifications at a second volume that is greater than the first volume; and wherein the second volume is selected in response to the predetermined interval using the first volume expiring.

11. The electronic device of claim 10, wherein the one or more processors further perform the following:

select the first notification preference from one of the first notification level, the second notification level, or third notification level based on the inactive state of the second person.

12. The electronic device of claim 7, further comprising at least one of a sound sensor, camera, global positioning system, or physiological sensor coupled to the one or more processors to obtain presence data indicative of one or more people in the environment.

13. The electronic device of claim 7, wherein the electronic device is at least one of an alarm clock, a smart phone, a television, a home automation electronic hub, or a wearable device.

14. The device of claim 7, wherein the one or more processors further perform the following:

determine that one person is within the environment based on the presence data;

select the first notification preference to apply based on the one person being determined within the environment.

15. A computer program product comprising a non-signal computer readable storage medium comprising computer executable code to:

obtain presence data indicative of one or more people in an environment;

analyze the presence data to determine activity of the one or more people in the environment;

determine a first notification preference and a second notification preference based on the activity of the one or more people in the environment;

applying the first notification preference at a predetermined time for a predetermined interval; and commanding a secondary device via a network over a communications channel that is physically separate from the network to apply the second notification preference in response to the predetermined interval expiring and based on the activity of the one or more people in the environment.

16. A computer program product of claim 15, wherein the non-signal computer readable storage medium comprising computer executable code to:

determine that a first person and a second person are within the environment based on the presence data;

determine that the first person is in an inactive state based on the presence data;

determine that the second person is in an inactive state based on the presence data;

select the first notification preference based the inactive state of the first person and the inactive state of the second person.

17. The computer program product of claim 15, wherein the non-signal computer readable storage medium comprising computer executable code to:

determine that a first person and a second person are within the environment based on the presence data;

determine that the first person is in an inactive state based on the presence data;

determine that the second person is in an active state based on the presence data;

select the first notification preference based the inactive state of the first person and the active state of the second person.

18. The computer program product of claim 15, wherein determining the first notification preference and second notification preference includes accessing a list that includes a first notification level and a second notification level; wherein the first notification level includes non-auditory notifications and the second notification level includes auditory notifications.

19. The computer program of claim 18, wherein the second notification level includes auditory notifications at a first volume; and wherein the list also includes a third notification level; wherein the third notification level includes auditory notifications at a second volume that is greater than the first volume; and wherein the second volume is selected in response to the predetermined interval using the first volume expiring and the activity of the one or more people in the environment.

* * * * *